US011785371B2

(12) United States Patent
Yoshino

(10) Patent No.: US 11,785,371 B2
(45) Date of Patent: Oct. 10, 2023

(54) MICROPHONE

(71) Applicant: Audio-Technica Corporation, Tokyo (JP)

(72) Inventor: Satoshi Yoshino, Tokyo (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 0 days.

(21) Appl. No.: 17/571,834

(22) Filed: Jan. 10, 2022

(65) Prior Publication Data

US 2022/0279261 A1 Sep. 1, 2022

(30) Foreign Application Priority Data

Jan. 15, 2021 (JP) ..... 2021-004698

(51) Int. Cl.
*H04R 1/08* (2006.01)
*H04R 1/04* (2006.01)

(52) U.S. Cl.
CPC ..... *H04R 1/086* (2013.01); *H04R 1/04* (2013.01)

(58) Field of Classification Search
CPC . H04R 1/086; H04R 1/04; H04R 1/02; H04R 2499/11; H04R 1/28; H04R 2201/02; G10K 9/22; G10K 2200/11; G10K 2210/127
USPC ..... 381/322, 189, 355, 359, 165
See application file for complete search history.

(56) References Cited

U.S. PATENT DOCUMENTS 6,018,585 A * 1/2000 Akino ..... H04R 1/086 381/189
2014/0064542 A1* 3/2014 Bright ..... H04R 1/086 381/359

FOREIGN PATENT DOCUMENTS

JP 2017055228 A 3/2017
JP 6557575 B2 8/2019

* cited by examiner

*Primary Examiner* — Norman Yu
(74) *Attorney, Agent, or Firm* — WCF IP

(57) ABSTRACT

A microphone includes an outer wall member having a sound hole, a first mesh arranged inside the outer wall member and made of Dutch weave, and a spacer having a diameter corresponding to an inner diameter of the outer wall member. The first mesh is pressed to an inside the outer wall member while a first surface of which is in contact with the first mesh. A second mesh is in contact with a second surface of the spacer and has water repellency. A microphone unit is stored under the second mesh.

10 Claims, 10 Drawing Sheets

MICROPHONE

TECHNICAL FIELD

The present invention relates to a microphone.

BACKGROUND ART

Microphones used under conditions where they are exposed to water are known. Such conditions include, for example, an outdoor use, a placement on a desk where beverages and the like may be spilled, or using by embedding in a desk.

In the past, for example, there has been disclosed a microphone having a windscreen which covers a first opening of a case with a sheet member imparted with air permeability and water repellency and has a drainage property on an outside of the case (for example, see a published unexamined patent application JP2017-55228A).

The microphone disclosed in JP2017-55228A is difficult to miniaturize because a windscreen is required. In addition, since the windscreen has a high water retentivity and easily absorbs water, it has been difficult to restore the windscreen to its original performance once it has been wet.

SUMMARY OF INVENTION

Technical Problem

An object of the present invention is to provide a microphone having high waterproofness and water repellency.

Solution to Problem

A microphone according to the present invention includes an outer wall member having a sound hole, a first mesh arranged inside the outer wall member and made of Dutch weave, a spacer having a diameter corresponding to an inner diameter of the outer wall member and pressing the first mesh to an inside the outer wall member while a first surface of which is in contact with the first mesh, a second mesh is in contact with a second surface of the spacer and having water repellency, and a microphone unit stored under the second mesh.

Effect of the Invention

According to the present invention, a microphone having high waterproofness and water repellency can be provided.

BRIEF DESCRIPTION OF DRAWINGS

FIG. 1(*b*) is a cross-sectional view of the microphone according to the first embodiment of the present invention.

FIG. 4(*b*) is a cross-sectional view of the microphone according to the second embodiment of the present invention.

FIG. 10(*b*) is a graph illustrating frequency response characteristics of a microphone according to a related art in which a volume ratio of a front air chamber to a rear air chamber is 1:3.

FIG. 10(*c*) is a graph illustrating frequency response characteristics of a microphone according to a related art in which a volume ratio of a front air chamber to a rear air chamber is 1:3.5.

PREFERRED EMBODIMENT

A microphone according to embodiments of the present invention will be described below with reference to the drawings. In the following description, an axial direction of a microphone 1 is referred to as a z direction, and a direction orthogonal to the z direction is referred to as a x direction and a y direction. A surface facing in a +z direction is also called a top surface, and a surface facing in a −z direction is called a bottom surface. Note that a direction arrangement of the microphone is not limited to this direction.

—Microphone (1)—

Figure 1A:
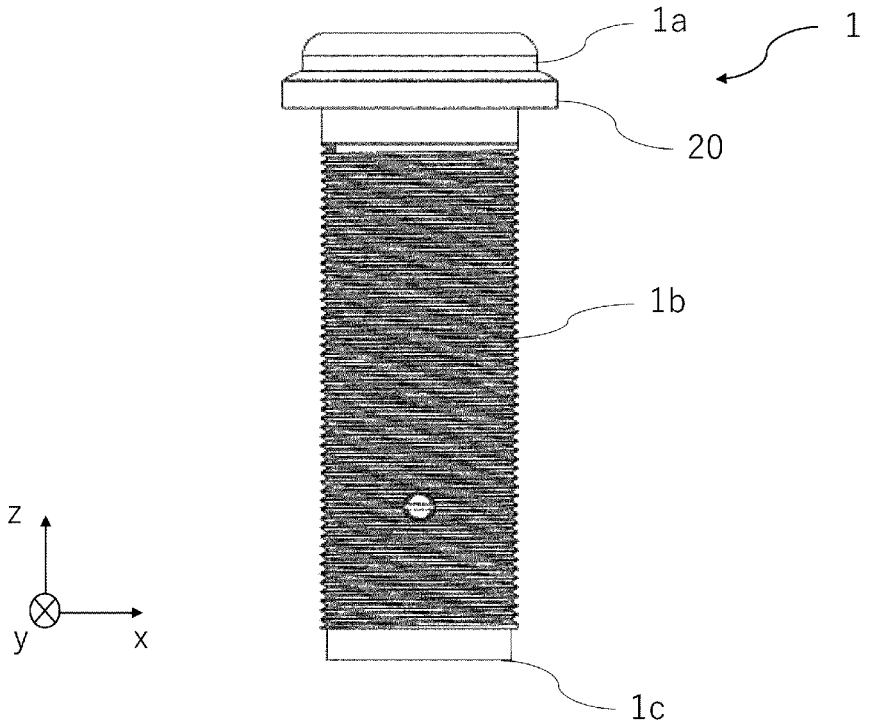
FIG. 1(*a*) is illustrating a side view of a microphone according to a first embodiment of the present invention.
Figure 1B:
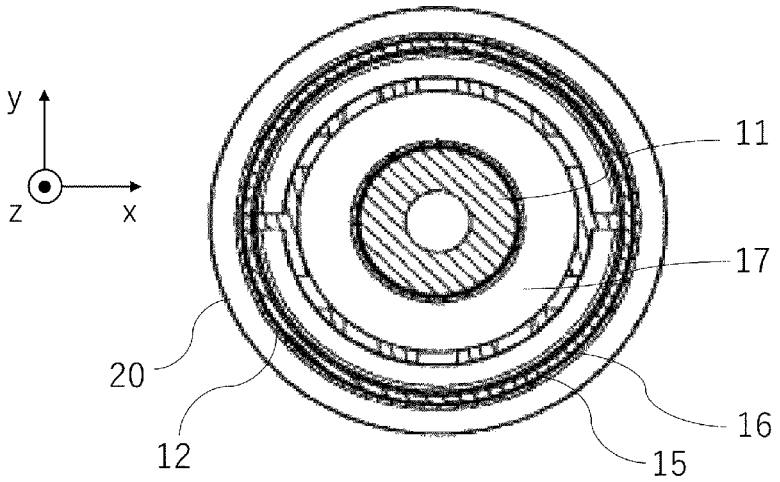
Figure 2:
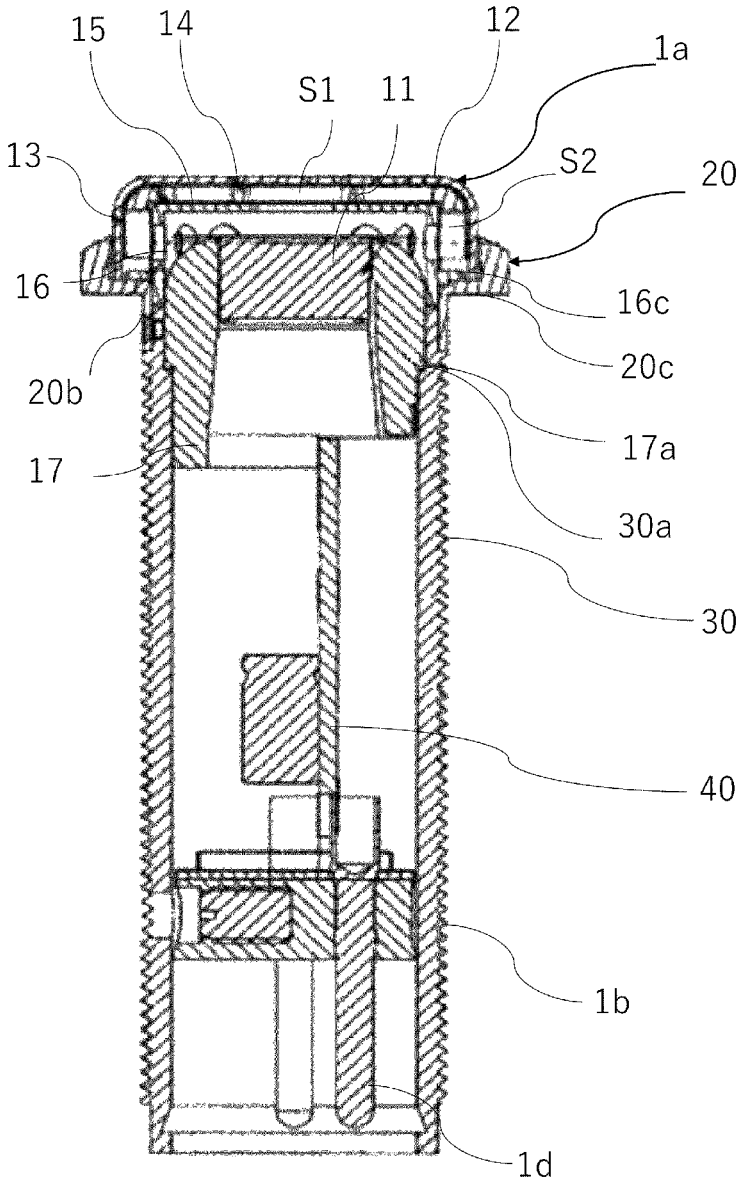
FIG. 2 is a longitudinal cross-sectional view of the microphone according to the first embodiment of the present invention.

As illustrated in FIG. 1 and FIG. 2, the microphone 1 is a substantially cylindrical member. The microphone 1 is provided with a unit section 1*a* for storing a microphone unit 11 (see FIG. 1) at an upper end part. Further, below the unit section 1*a* of the microphone, a screw section 1*b* is screwed on an outer peripheral surface of a case 30. The microphone 1 is fixed to an installation surface by screwing the screw section 1*b* with a screw hole provided on the installation surface of a desk or a ceiling. A circuit board 40 is arranged inside the case 30. On the circuit board 40, for example, a field effect transistor (FET) as an impedance converter, an amplifier circuit, a low-cut circuit, and the like, are mounted. An output connector 1*d* (see FIG. 2) is arranged on a bottom surface 1*c* of the microphone 1. The microphone unit 11 is electrically connected to external devices via an output connector 1*d*.

Figure 3:
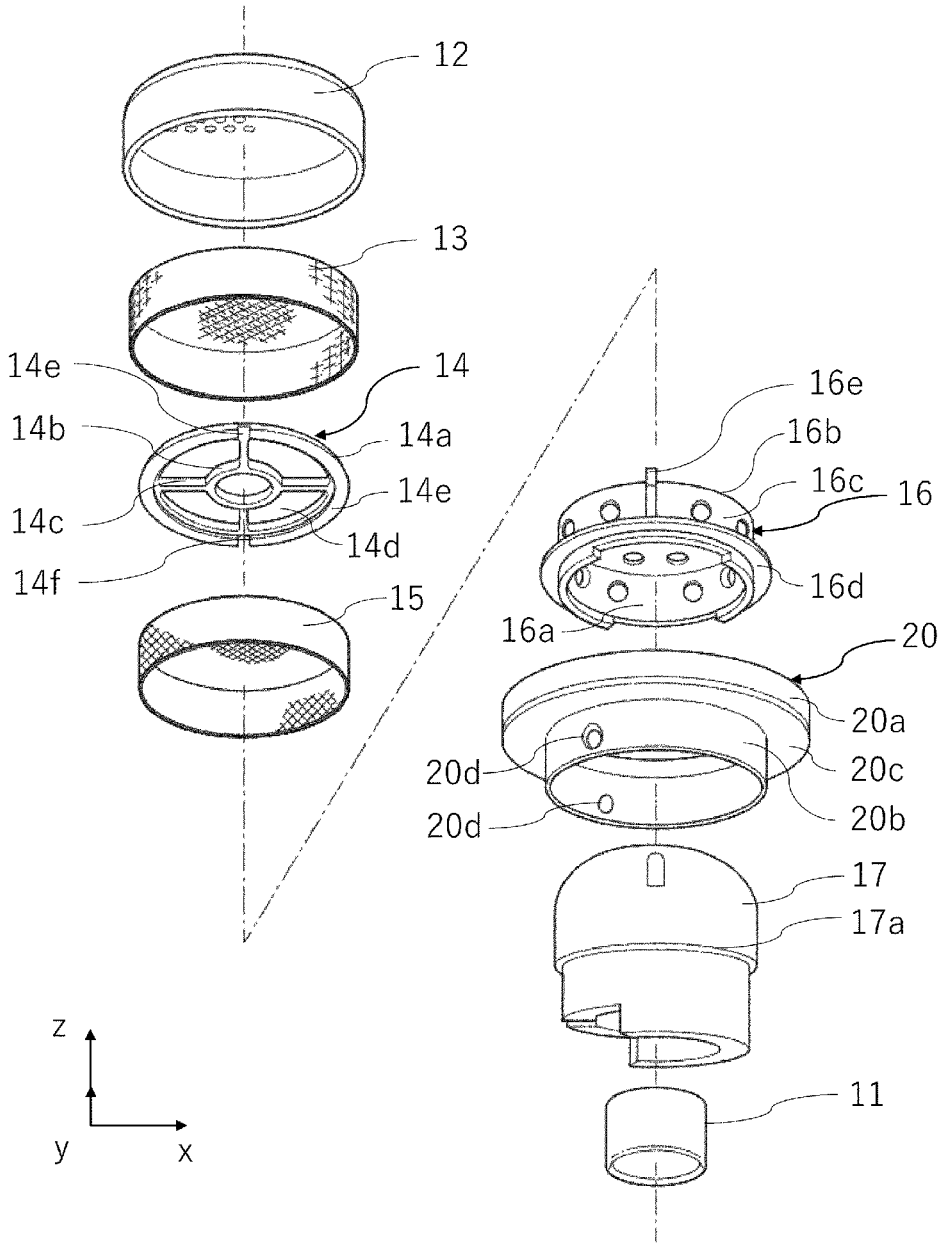
FIG. 3 is an exploded perspective view of the microphone according to the first embodiment of the present invention.
Figure 4A:
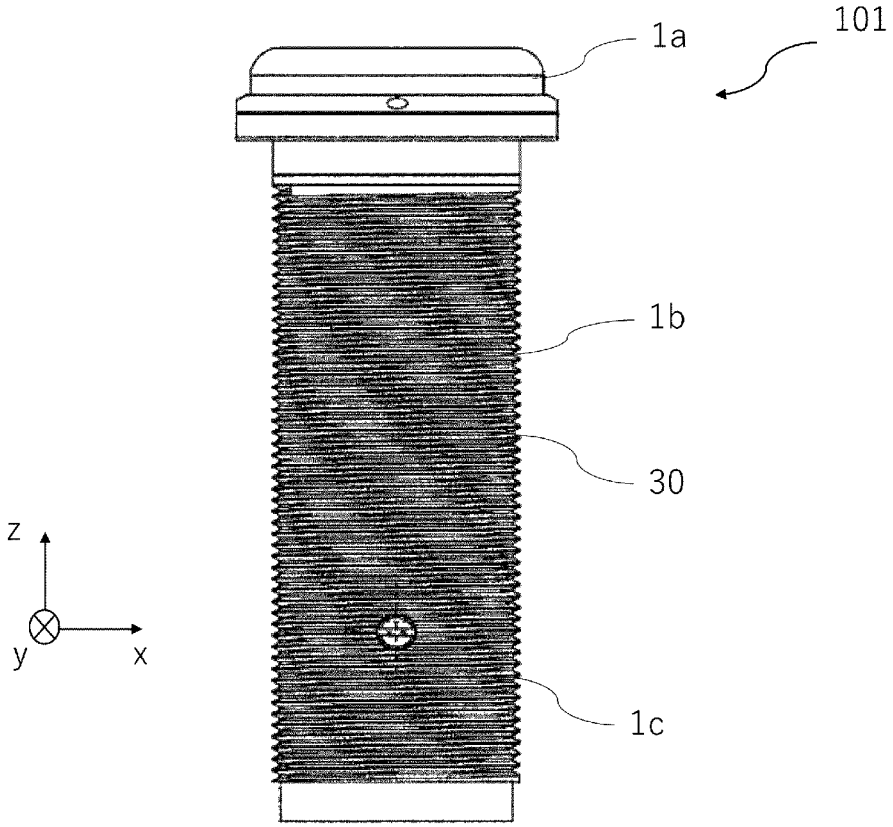
FIG. 4(*a*) is illustrating a side view of a microphone according to a second embodiment of the present invention.
Figure 4B:
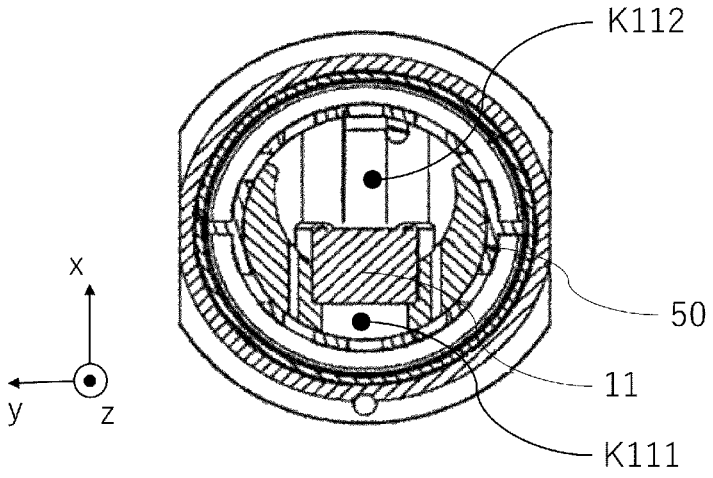

As illustrated in FIG. 2 and FIG. 3, the unit section 1*a* mainly has the microphone unit 11, an outer wall member 12, a first mesh 13, a spacer 14, a second mesh 15, a cover 16, and a fixing section 20.

The microphone unit 11 includes a diaphragm, which is a member that converts sound waves from an outside of the microphone 1 into an electric signal. The microphone unit 11 is a substantially cylindrical member. In this embodiment, a bottom surface of the microphone unit 11 does not communicate with the outside. In other words, the microphone 1 is omnidirectional. The technical scope of the present invention is not limited thereto.

The outer wall member 12 is a member that constitutes an upper surface outer wall of the microphone 1, and is a bottomed cylindrical member provided with a plurality of sound holes. The outer wall member 12 is composed of, for example, an etching plate or a punching plate having holes of a small diameter. Alternatively, the outer wall member 12 may have an etching plate provided in a wire mesh. Further, the outer wall member 12 may have one large hole on a top surface instead of the plurality of sound holes. The first mesh 13 is pressed against an inner wall of the outer wall member 12.

The first mesh 13 is a mesh made of metal or resin. The first mesh 13 is woven by a Dutch weave. The Dutch weave is, for example, a plain Dutch weave or a twilled Dutch weave. A plain Dutch-woven wire gauge is a wire gauge woven by enlarging a mesh by vertical lines and sequentially adhering horizontal lines. A twilled Dutch-woven wire gauge is that a structure of a Dutch woven wire gauge is further made into twill weave. Since horizontal lines of the twilled Dutch-woven wire gauge are in close contact with each other on both front and back sides of wire metals, a density of the twilled Dutch-woven wire gauge is higher than that of the plain Dutch-woven wire gauge.

The Dutch weave is a weave in which horizontal lines travel diagonally from a front surface to a back surface of adjacent vertical lines with respect to a plane of a wire gauge. Therefore, ventilation holes do not go straight. Thus, according to the first mesh 13 made of the Dutch weave, there are no planar openings of the weave as in case of a plain weave or the like, and a liquid passes through gaps at intersections of the vertical lines and the horizontal lines. In other words, the liquid traveling from an outside toward the first mesh 13 meanders into an inside. Therefore, according to the first mesh 13, the water pressure of the liquid from the outside can be reduced.

Further, by using the first mesh 13 made of the Dutch-woven wire gauge, the microphone 1 can be made smaller than a microphone having a urethane windscreen. In addition, according to the first mesh 13 made of the Dutch-woven wire gauge, a performance of the microphone 1 can be ensured because dust, sand, and dirt, are less likely to stick on the mesh and the mesh is less likely to be clogged as compared with the urethane windscreen. Therefore, the microphone 1 can be used outdoors.

The first mesh 13 can repel a small amount of liquid or a liquid having a small water pressure due to surface tension. Therefore, the microphone 1 can be easily restored to its original condition by wiping off water droplets on the surface when the water is spilled from a cup or a light rain. Further, according to a structure in which the first mesh 13 located on the outside is made of metal, the microphone 1 has lower water retentivity than the urethane windscreen, so that it can be easily dried even when liquid adheres. For example, in a case where the microphone 1 is embedded in a desk and only an upper part is exposed to the upper surface of the desk, the microphone 1 can be easily dried even when the liquid is spilled on the desk, and a sound collecting performance can be maintained.

The first mesh 13 made of metal has higher durability than that of urethane. Therefore, since a frequency of maintenance of the microphone 1 can be reduced, the microphone 1 can be easily used even in a place where operators cannot easily reach, such as outdoors or a ceiling.

The spacer 14 is a substantially annular member. The spacer 14 has an annulus 14*a*, a small annulus 14*b*, and plurality of spokes 14*c*. The annulus 14*a* constitutes an outer periphery of the spacer 14, and the small annulus 14*b* is substantially concentric with the annulus 14*a* and is arranged inside the annulus 14*a*. Further, the spokes 14*c* connect the annulus 14*a* and the small annulus 14*b*. In other words, the spacer 14 has a plurality of through holes 14*d* surrounded by the annulus 14*a*, the small annulus 14*b*, and the plurality of spokes 14*c*. Further, a rib 14*e* protruding in a thickness direction over an entire circumference of an outer edge is arranged on the annulus 14*a*.

The spacer 14 has a diameter that fits inside the outer wall member 12. Further, the spacer 14 is an elastic member made of, for example, a resin or the like. An outer diameter of the annulus 14*a* in a natural state is slightly larger than an inner diameter of the outer wall member 12. According to this configuration, when the first mesh 13 and the spacer 14 are press-fitted into the outer wall member 12 together with the spacer 14, the spacer 14 expands inside the outer wall member 12. In other words, a first surface of the spacer 14 is in contact with the first mesh 13 and presses the first mesh 13 into the outer wall member 12. Then, the first mesh and the spacer 14 are fixed to inside the outer wall member 12.

The annulus 14*a* of the spacer 14 has a pair of recess parts 14*f* facing each other. The recess parts 14*f* are fitted into protrusion parts 16*e* of the cover 16 in an assembled state.

The cover 16 is a bottomed cylindrical member having an opening 16*a* on a bottom surface side (−z side) of the microphone 1. The cover 16 is made of, for example, resin. The cover 16 has the second mesh 15 fixed to a bottom part 16*b* and an outer peripheral surface 16*c*. In other words, a second surface of the spacer 14 is in contact with the second mesh 15 fixed to the bottom part 16*b*.

The second mesh 15 is a mesh having water repellency, for example, made of plain weave. The second mesh 15 may be made of metal or resin. The second mesh 15 repels liquid entering from the outside and prevents the liquid from entering the inside of the cover 16. Further, the cover 16 has a plurality of holes in the bottom part 16*b* and the outer peripheral surface 16*c*. External sound reaches the microphone unit 11 through the holes and the second mesh 15.

As described above, the microphone 1 according to the present invention realizes high waterproofness and water repellency by the first mesh 13 and the second mesh 15, which are having different weaves. Specifically, as a result of the liquid spilled on the microphone 1 being dispersed by the first mesh 13, a weight of the liquid is reduced and a water pressure per unit is reduced. By repelling the liquid with the second mesh 15, the microphone 1 can surely prevent the liquid from entering the inside. The outer wall member 12 arranges an inflow direction of the liquid in a direction orthogonal to the first mesh 13 by the sound holes. In other words, an effect of reducing water pressure by the first mesh 13 is more increased by the outer wall member 12. Further, a first gap K1 between the first mesh 13 and the second mesh 15 further reduces the water pressure and reliably prevents the liquid from entering by the second mesh 15.

The first mesh 13 has a high acoustic resistance because not only the liquid but also gas cannot pass straight through the first mesh 13. Therefore, a configuration for controlling an acoustic resistance value generated by the first mesh 13 and ensuring the characteristics of the microphone 1 will be described below.

As described above with reference to FIG. 2 and FIG. 3, the spacer 14 is arranged between the first mesh 13 and the second mesh 15. In other words, a first gap K1 is formed between the first mesh 13 and the second mesh 15 in the axial direction of the microphone 1. The first gap K1 is formed by a side wall of the through holes partitioned by the annulus 14*a* of the spacer 14, the small annulus 14*b*, and the spokes 14*c*. A plurality of the first gap K1 are arranged side by side on an x-y plane. Further, the rib 14*e* of the annulus 14*a* of the spacer 14 presses the first mesh 13 along a curved part of the outer wall member 12. As a result, a second gap K2 partitioned by the ribs 14*e*, the second mesh 15 fixed to the outer peripheral surface 16*c* of the cover 16, and a side wall inside a first annulus 20*a* of the fixing section 20, is formed.

According to the configuration in which the spacer 14 presses the first mesh 13 against an inner wall of the outer wall member 12, volumes of the first gap K1 and the second gap K2 formed between the first mesh 13 and the second mesh 15 can be made constant. In other words, the acoustic resistance value generated by the first mesh 13 becomes substantially constant for each individual in mass production and is maintained over a long period of time. As a result, the microphone 1 can be designed in consideration of the acoustic resistance by the first mesh 13, so that characteristics of the microphone 1 can be ensured while the first mesh 13 having the high acoustic resistance is arranged outside the microphone unit 11.

The outer peripheral surface 16*c* of the cover 16 has the protrusion parts 16*e* protruding in a radial direction. The protrusion parts 16*e* are formed in pairs at positions facing each other and are aligned with the recess parts 14*f* of the spacer 14. In this embodiment, a number of the recess parts 14*f* and a number of the protrusion parts 16*e* are two each, but the numbers are examples. Further, the cover 16 has a rib 16*d* protruding in a radial direction over an entire circumference at an end of the opening 16*a*. The rib 16*d* is in contact with an inner wall of a stepped part 20*c* (see FIG. 2) formed on the fixing section 20 and a position in an axial direction is fixed.

A unit holding member 17 is a cylindrical member that holds the microphone unit 11 inside. The unit holding member 17 is made of a member having an elastic force such as an elastomer or rubber. As illustrated in FIG. 2, the unit holding member 17 holds the microphone unit 11 at an upper end part and is stored in an upper end of the case 30. Further, an outer diameter of an upper surface side of the unit holding member 17 is larger than an outer diameter of a bottom surface side. This difference in the outer diameters forms a stepped part 17*a* over an entire circumference of the outer peripheral surface. On the other hand, an inner diameter of an upper end part of the case 30 is larger than an inner diameter of a central part. This difference in the inner diameter forms a stepped part 30*a* on the inner wall of the case 30. The stepped part 17*a* of the unit holding member 17 is in contact with the stepped part 30*a*.

The fixing section 20 is an annular member that holds the cover 16. The fixing section 20 has a shape in which a first annulus 20*a* and a second annulus 20*b* having different diameters are connected by a stepped portion 20*c* over an entire circumference. The inner diameter of the first annulus 20*a* is larger than that of the second annulus 20*b*. The outer wall member 12 is fitted inside the first annulus 20*a*. The first annulus 20*a* and the outer wall member 12 integrally hold the first mesh 13, the spacer 14, and the second mesh 15. The upper end part of the case 30 is inserted through the second annulus 20*b*, and the second annulus 20*b* and the case 30 are connected to each other. A mode of connection can be appropriately selected, but the second annulus 20*b* and the case 30, for example, may be connected by screws inserted into small holes 20*d* of the second annulus 20*b* and holes of the case 30.

As described above, according to the microphone 1 of the present invention, high waterproofness and water repellency can be realized.

—Microphone (2)—

A second embodiment of the microphone according to the present invention will be described with reference to parts different from those of the first embodiment. The microphone according to the second embodiment is different from the microphone according to the first embodiment in that a side of the front surface and the rear side of the microphone unit are opened to constitute a directional microphone. In the following figures, the same components as those in the first embodiment are denoted by the same reference numerals.

Figure 5:
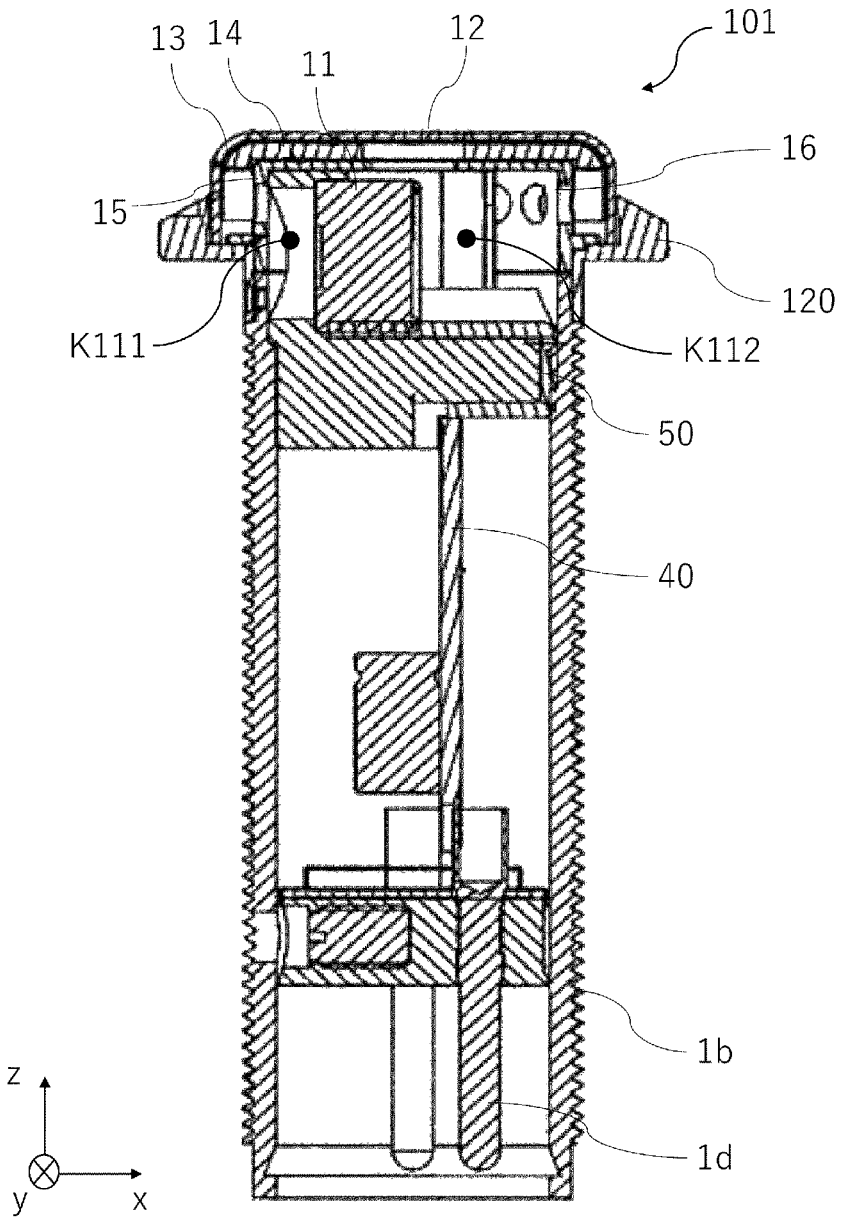
FIG. 5 is a longitudinal cross-sectional view of the microphone according to the second embodiment of the present invention.
Figure 6:
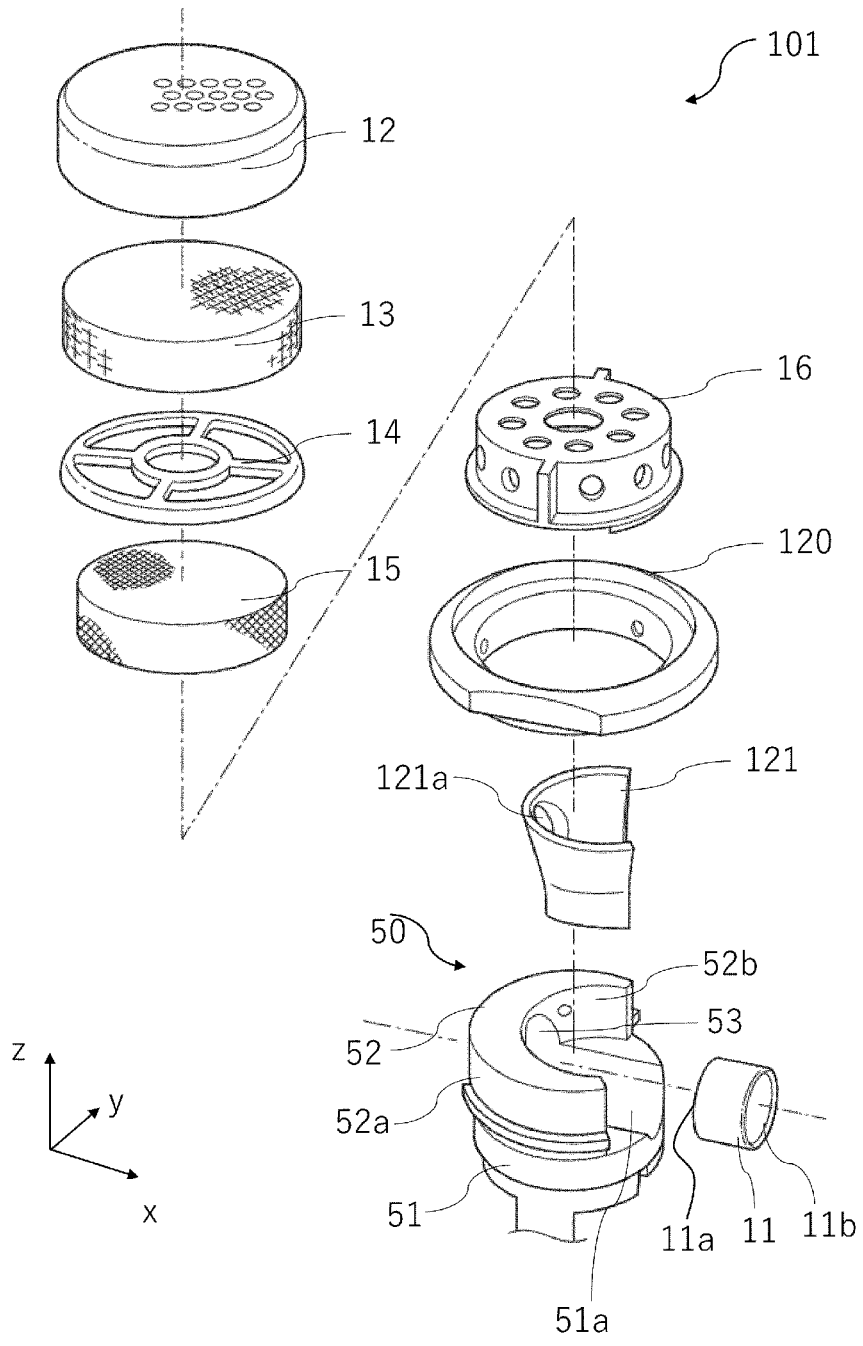
FIG. 6 is an exploded perspective view of the microphone according to the second embodiment of the present invention.

As illustrated in FIG. 5 and FIG. 6, in the present embodiment, the microphone unit 11 is held in a direction substantially orthogonal to an axial direction of the microphone 101 (an x direction in the figure). The microphone unit 11 is held by the acoustic adjustment member 50. The front surface 11*a* and the rear surface 11*b* of the microphone unit 11 are sound collecting surfaces, respectively.

The acoustic adjustment member 50 is a member that holds the microphone unit 11 and connected to the case 30. The acoustic adjustment member 50 may be made of an elastic material. For example, the acoustic adjustment member 50 is made of an elastomer or a rubber molded product. According to this configuration, the acoustic adjustment member 50 is press-fitted and expanded inside the case 30, whereby the acoustic adjustment member 50 is connected to the case without any gap.

The acoustic adjustment member 50 mainly has a base 51 and the acoustic adjustment unit 52. The base 51 is a substantially columnar member having an outer diameter corresponding to an inner peripheral surface of the case. The base 51 is a member that holds the microphone unit 11 and is connected to the case in a lower part of the acoustic adjustment member 50.

The base 51 has a substantially cylindrical housing member 51*a* on an upper surface. The housing member 51*a* has a shape corresponding to the outer circumference of the microphone unit 11. The housing member 51*a* is formed in the x direction. The housing member 51*a* stores the microphone unit 11 in an assembled state.

The acoustic adjustment unit 52 is a member arranged on an upper part of the base 51. The base 51 and the acoustic adjustment unit 52 may be integrally formed. The acoustic adjustment unit 52 is a crescent-shaped member. In other words, an outer peripheral surface of the acoustic adjustment unit 52 has a shape in which a first curved surface 52*a*, curved in a convex shape, and a second curved surface 52*b*, curved in a concave shape, are connected. The first curved surface 52*a* and the second curved surface 52*b* are cylindrical surfaces, and a curvature of the second curved surface 52*b* is larger than a curvature of the first curved surface 52*a*. The first curved surface 52*a* may be formed along an outer periphery of the base 51. An upper surface of the acoustic adjustment unit 52 is in contact with an inner wall of the cover 16.

According to the configuration in which the acoustic adjustment unit 52 and the case 30 are integrated, even a small-sized microphone 101 can have a long distance between acoustic terminals. Therefore, according to this configuration, a microphone with high directivity can be realized. The acoustic terminal refers to a position of an air that effectively applies a sound pressure to the microphone unit, and is a center position of the air that moves at the same time as a diaphragm provided in the microphone unit.

Figure 7:
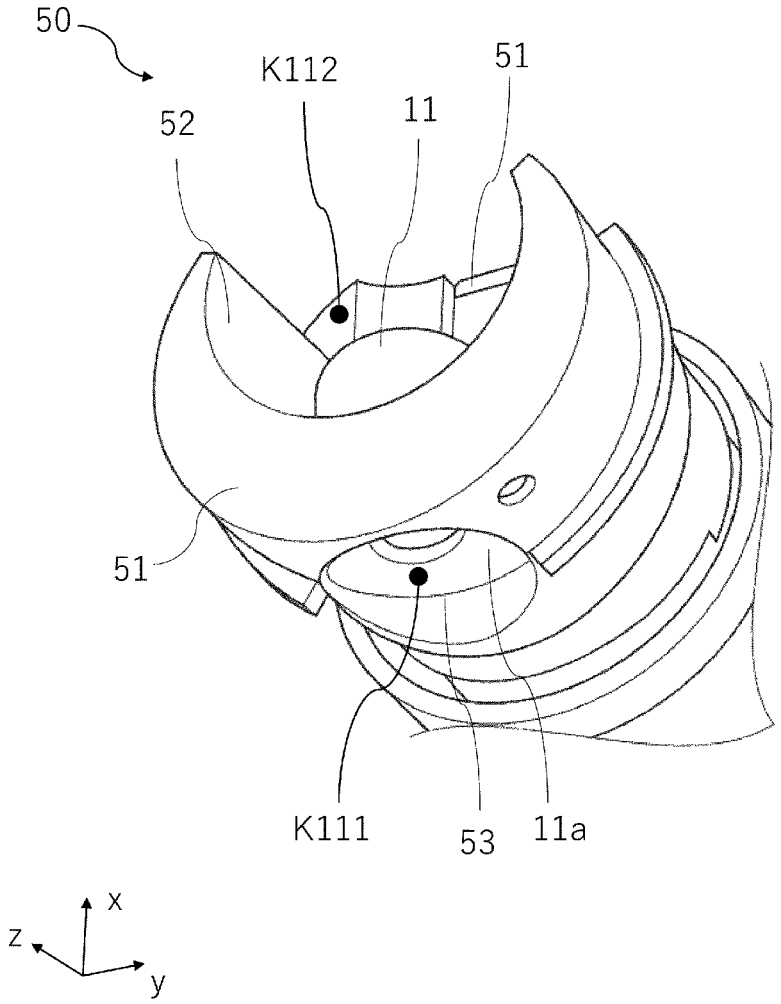
FIG. 7 is a partially enlarged perspective view illustrating an acoustic adjustment member and a microphone unit of the above mentioned microphone, in which some members are omitted.

As illustrated in FIG. 6 and FIG. 7, the acoustic adjustment unit 52 has a through hole 53 that penetrates the first curved surface 52*a* and the second curved surface 52*b* in a x direction. The through hole 53 is arranged above a housing member 51*a*. The microphone unit 11 is stored so that an outer peripheral surface of the microphone unit 11 is in contact with the housing member 51*a* and a part of the front surface 11*a* is arranged at a position of the through hole 52 from a second curved surface 52*b* side. As a result, at least the part of the front surface 11*a* of the microphone unit 11 is opened to the first curved surface 52*a* side through the through hole 53.

A front side air chamber K111 is formed on a side of the front surface 11*a* of the microphone unit 11. The front side air chamber K111 is a region surrounded by the front surface 11*a* of the microphone 11, an inner wall of the through hole 53, the cover 16, and the second mesh 15 connected to an outer periphery of the cover 16. A rear side air chamber K112 is formed on a side of a rear surface 11*b* of the microphone unit 11. The rear side air chamber K112 is a region surrounded by the rear surface 11*b* of the microphone unit 11, the second curved surface 52*b* of the acoustic adjustment unit 52, the cover 16, and the second mesh 15 connected to the outer periphery of the cover 16.

In other words, the acoustic adjustment unit 52 partitions the front side air chamber K111 and the rear side air chamber K112 inside the microphone 101.

A volume of the rear side air chamber K112 is sufficiently larger than a volume of the front side air chamber K111. When the first mesh 13 having a large acoustic resistance is arranged between a sound source and the microphone unit 11, a distance between terminals of a front acoustic terminal and a rear acoustic terminal becomes small, and a vibration of the diaphragm becomes small. Therefore, by making the rear side air chamber K112 larger than the front side air chamber K111, an impedance on a back side becomes smaller and a driving force of the diaphragm can be maintained. In other words, according to this configuration, a microphone having waterproofness, water repellency, and high directivity can be realized.

For example, a volume ratio of the front side air chamber K111 and the rear side air chamber K112 is 1:7. In this waterproof structure, the volume ratio of the front side air chamber K111 and the rear side air chamber K112 is preferably around 1:7 to 1:10. The microphone 101 having the volume ratio of the front side air chamber K111 and the rear side air chamber K112 around 1:7 to 1:10 can sufficiently maintain the driving force of the diaphragm. When the volume ratio is smaller than 1:7 in this embodiment, a sound collection performance in a sound collection band is insufficient. A configuration in which the volume ratio is larger than 1:10 is not preferable due to restrictions on an outer shape of the microphone 101.

As illustrated in FIG. 6, in the present embodiment, a holding member 121 is arranged between an acoustic adjustment member 50 and the microphone unit 11. The holding member 121 is a partially cylindrical member located on the side of the front surface 11*a* of the microphone unit 11. Further, a diameter of the holding member 121 is expanded from a substantially central part upward. The holding member 121 has a through hole 121*a* at a position corresponding to the front surface 11*a* of the microphone unit 11. The holding member 121 may be omitted, and the microphone unit 11 may be held by, for example, the acoustic adjustment unit 52 or a fixing section 120.

Further, in the present embodiment, instead of the fixing section 20, a fixing section 120 in which a part of an outer peripheral surface is linearly cut out is connected to the outer wall member 12 and the case 30. Cutout surfaces of this cutting out are substantially parallel to each other. In addition, instead of the fixing section 120, the fixing section 20 having a substantially cylindrical outer periphery may be connected to the outer wall member 12 and the case 30 in this embodiment as well. Further, a number of the cutout surfaces is two in the present embodiment, but it may be one or three or more.

Acoustic Equivalent Circuit

Figure 8:
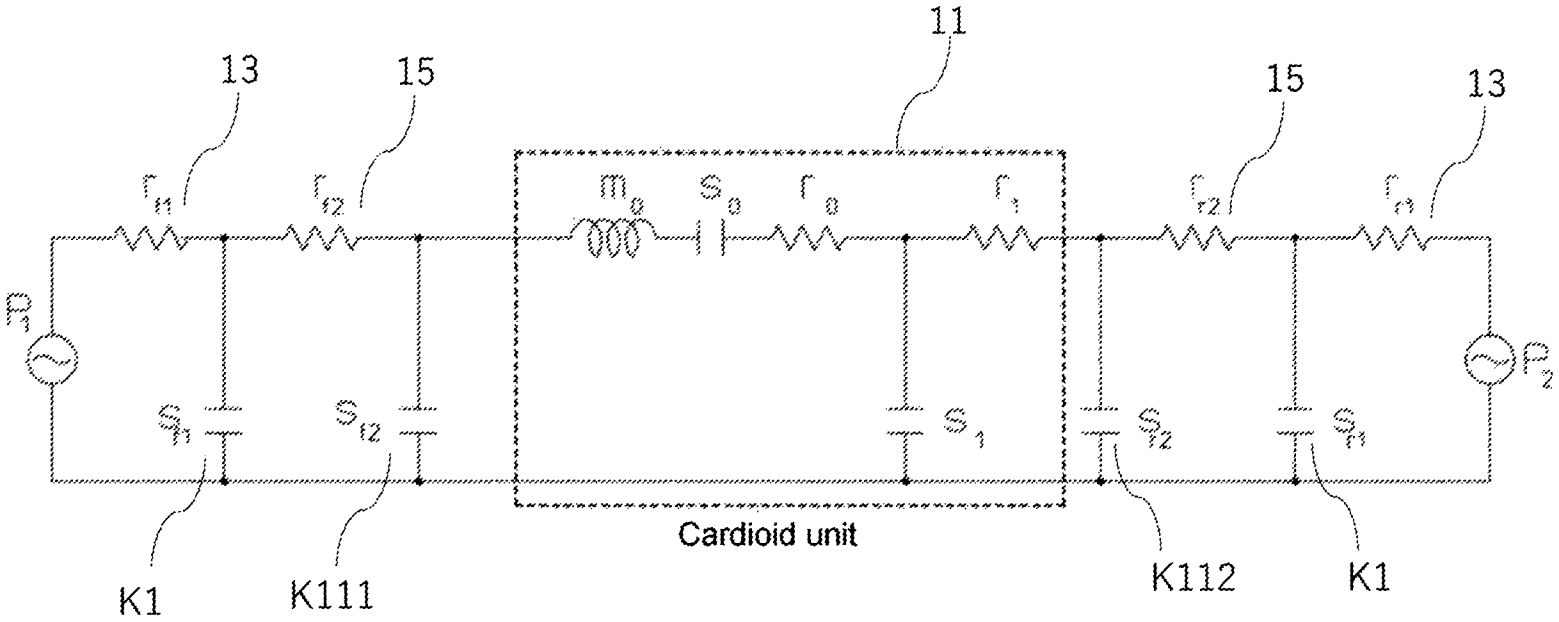
FIG. 8 is an acoustic equivalent circuit diagram of the above mentioned microphone.

Here, a configuration of the microphone 101 will be described using an acoustic equivalent circuit. As illustrated in FIG. 8, an audio signal source P1 and an audio signal source P2 are arranged on a front side and a rear side of the microphone unit 11, respectively. The audio signal source P1 located on the front side and the microphone unit 11 are equivalently connected via an acoustic resistance rf1 by the first mesh 13 and an acoustic resistance rf2 by the second mesh 15 connected in series. In addition, an acoustic stiffness Sf2 generated by the first gap K1 is connected in parallel between the acoustic resistance rf1 and the acoustic resistance rf2. Further, an acoustic stiffness Sf2 generated by the front side air chamber K111 is connected in parallel between the acoustic resistance rf2 and the microphone unit 11.

The audio signal source P2 located on the rear side and the microphone unit 11 are equivalently connected via an acoustic resistance rr1 by the first mesh 13 and an acoustic resistance rr2 by the second mesh 15 connected in serial. Further, between the audio signal source P2 and the microphone unit 11, an acoustic stiffness Sr1 generated by the first gap K1 is connected in parallel between the acoustic resistance rr1 and the acoustic resistance rr2. Here, the acoustic resistance rr1 and the acoustic resistance rf1, the acoustic resistance rr2 and the acoustic resistance rf2, and the acoustic stiffness Sr1 and the acoustic stiffness Sf1 are substantially equivalent to each other.

An acoustic stiffness Sr2 generated by the rear side air chamber K112 is connected in parallel between the acoustic resistance rr2 and the microphone unit 11. When a difference between the acoustic stiffness Sf2 and the acoustic stiffness Sr2 is small, in a predetermined frequency range in which a distance between a front side sound wave introduction hole and a rear side sound wave introduction hole and a half wavelength of the sound wave, resonance occurs on the front side and the rear side of the microphone unit 11 and a load is generated on the diaphragm inside the microphone unit 11. In other words, a level of the sound collected in the frequency range becomes small.

When a difference between the acoustic stiffness Sf2 and the acoustic stiffness Sr2 is sufficiently large, a phase difference and a pressure difference are generated between a front surface side and a rear surface side, and the diaphragm operates sufficiently. Therefore, the microphone of the second embodiment operates as a sound pressure gradient type microphone because the diaphragm has a sufficient driving force and high directivity. Further, by shifting the resonance frequency of the front side and the rear side, the resonance at the above-mentioned predetermined frequency is suppressed.

Frequency Response Characteristics

Figure 9:
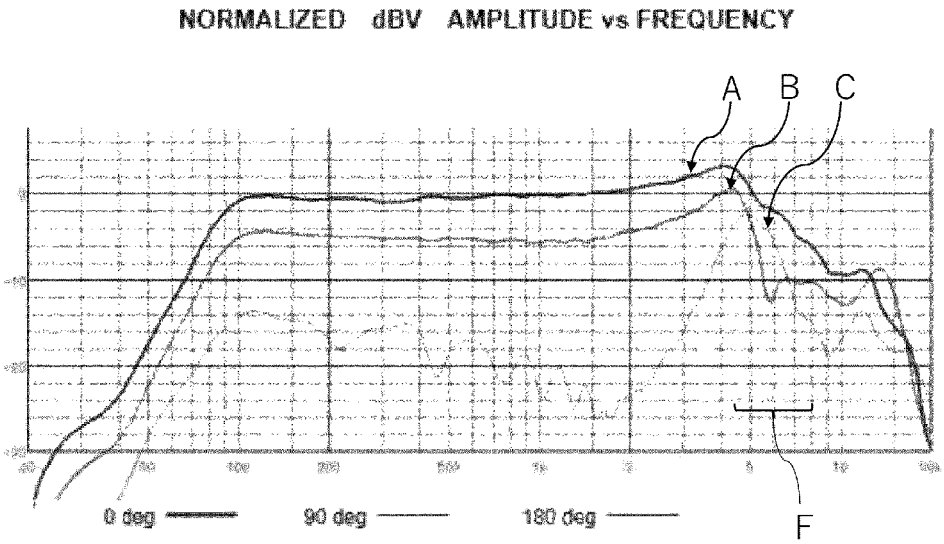
FIG. 9 is a graph illustrating frequency response characteristics of the above mentioned microphone.
Figure 10A:
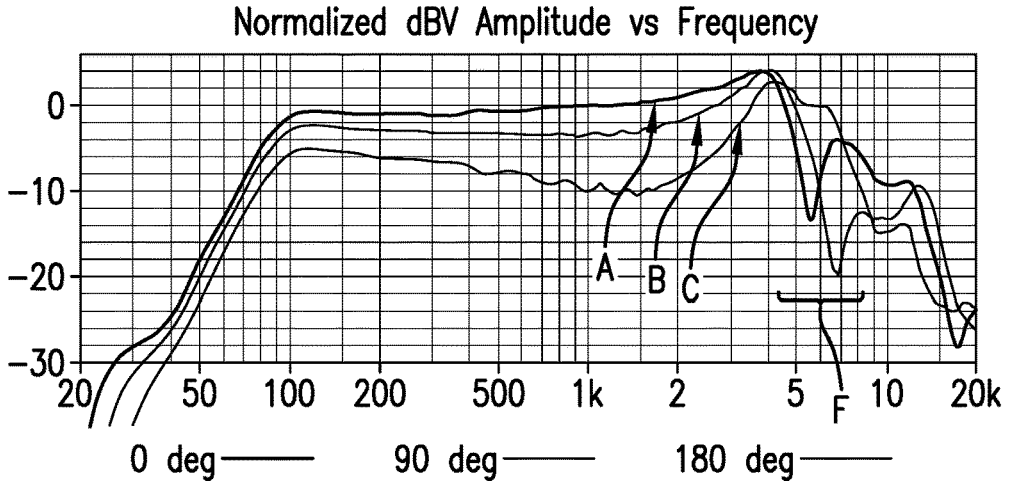
FIG. 10(*a*) is a graph illustrating frequency response characteristics of a microphone according to a related art in which a volume ratio of a front air chamber to a rear air chamber is 1:2.5.
Figure 10B:
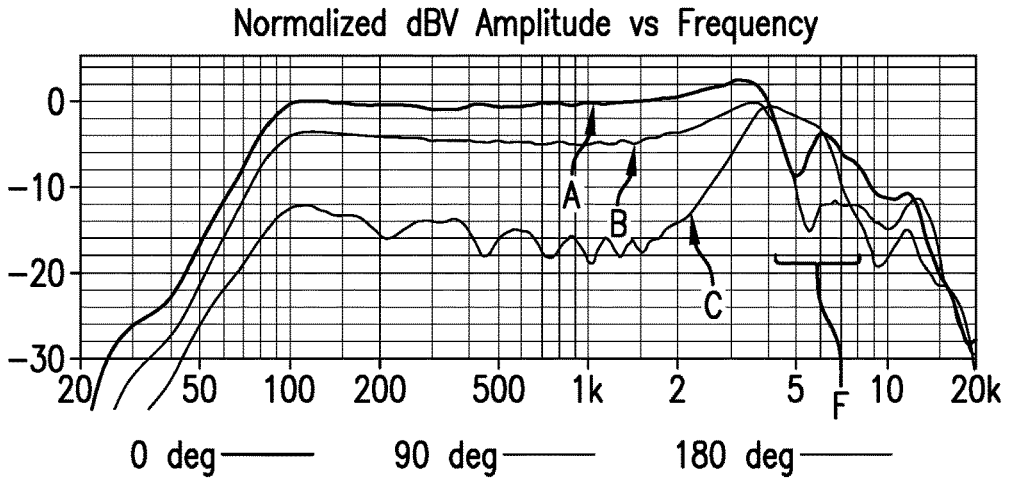
Figure 10C:
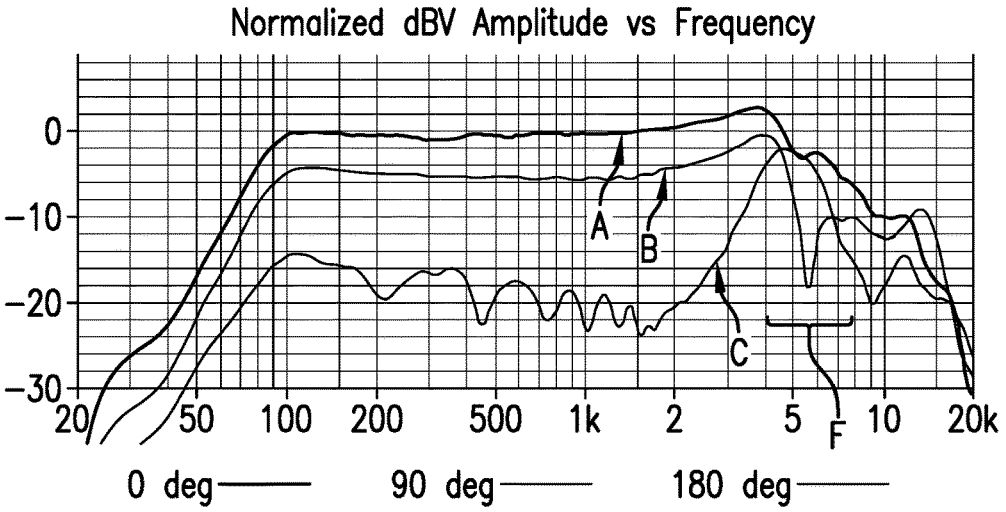

FIG. 9 and FIG. 10 illustrates frequency response characteristics of the microphone. In other words, a horizontal axis indicates a frequency and a vertical axis indicates an output level (dBV). A characteristic A is 0 degrees with respect to a sound collection axis that is when the sound wave arrives from a front, a characteristic B is 90 degrees that is when the sound wave arrives from a side, and a characteristic C is 180 degrees that is when the sound wave arrives from a back. Test conditions in FIG. 9 and FIG. 10 are the same except for the volume ratio of the front side air chamber and the rear side air chamber.

FIG. 10(*a*) illustrates the frequency response characteristics of the microphone in which the volume ratio of the front air chamber to the rear air chamber is 1:2.5. FIG. 10(*b*) illustrates the frequency response characteristics of the microphone in which the volume ratio of the front air chamber to the rear air chamber is 1:3. FIG. 10(*c*) illustrates the frequency response characteristics of the microphone in which the volume ratio of the front air chamber to the rear air chamber is 1:3.5. In each figure, a downward peak appears in each characteristic in a frequency range F, which is near a threshold frequency at high frequencies. In other words, the microphone having this configuration cannot sufficiently collect sound in the frequency region F of the sound collection band. This is because, in the frequency region F, the acoustic equivalent circuit configured on the front surface side and the rear surface side resonate with each other and the vibration of the diaphragm is reduced. According to each figure, the downward peak becomes smaller as the volume ratio becomes larger.

FIG. 9 illustrates the frequency response characteristics of the microphone in which the volume ratio of the front air chamber K111 to the rear air chamber K112 is 1:7. In the figure, the frequency response characteristic smoothly decreases even in the frequency range F. In other words, the microphone having this configuration can sufficiently collect sound over the sound collection band.

As described above, according to the microphone in which the volume of the rear air chamber is sufficiently larger than the volume of the front air chamber, sound can be collected well over the sound collection band.

According to the embodiments described above, the microphone having high waterproofness and water repellency can be realized.

EXPLANATION OF SYMBOLS

1 microphone
11 microphone unit
12 outer wall member
13 first mesh
14 cover
15 second mesh
101 microphone
50 acoustic adjustment member

The invention claimed is:

1. A microphone comprising:
an outer wall member having a sound hole;
a first mesh arranged inside the outer wall member and made of Dutch weave;
a spacer having a diameter corresponding to an inner diameter of the outer wall member and pressing the first mesh to an inside the outer wall member while a first surface of the spacer is in contact with the first mesh;
a second mesh is in contact with a second surface of the spacer and having water repellency; and
a microphone unit stored under the second mesh,
wherein the first mesh and the second mesh are superimposed in front of the microphone unit via the spacer.

2. The microphone according to claim 1, wherein the spacer comprising a through hole penetrating the first surface and the second surface, and further comprising a first gap partitioned by a side wall of the through hole, the first mesh, and the second mesh.

3. The microphone according to claim 1,
wherein the spacer comprises a rib protruding toward the second mesh over an entire circumference of an outer edge, and further comprising a second gap partitioned by the second mesh, the rib, and an inner wall of the outer wall member.

4. The microphone according to claim 1, further comprising
an acoustic adjustment member supporting the microphone unit below the second mesh,
wherein the acoustic adjustment member is configured for partitioning a front side air chamber formed on a side of a front surface of the microphone unit and a rear side air chamber formed on a side of a rear surface of the microphone unit,
wherein the acoustic adjustment member comprises a through hole which opens at least a part of the front surface to the front side air chamber, and
wherein a volume of the rear side air chamber is larger than a volume of the front side air chamber.

5. The microphone according to claim 4, wherein a volume ratio of the front side air chamber and the rear side air chamber is in a ratio between 1:7 and 1:10.

6. The microphone according to claim 4, wherein the acoustic adjustment unit has a convex first curved surface and a concave second curved surface, and the front surface of the microphone unit is in contact with the second curved surface.

7. A microphone comprising:
an outer wall member having a sound hole;
a first mesh arranged inside the outer wall member and made of Dutch weave;
a spacer having a diameter corresponding to an inner diameter of the outer wall member and pressing the first mesh to an inside the outer wall member while a first surface of the spacer is in contact with the first mesh;
a second mesh is in contact with a second surface of the spacer and having water repellency; and
a microphone unit stored under the second mesh,
wherein the spacer comprises a rib protruding toward the second mesh over an entire circumference of an outer edge, and further comprising a second gap partitioned by the second mesh, the rib, and an inner wall of the outer wall member.

8. A microphone comprising:
an outer wall member having a sound hole;
a first mesh arranged inside the outer wall member and made of Dutch weave;
a spacer having a diameter corresponding to an inner diameter of the outer wall member and pressing the first mesh to an inside the outer wall member while a first surface of the spacer is in contact with the first mesh;
a second mesh is in contact with a second surface of the spacer and having water repellency; and
a microphone unit stored under the second mesh; and
an acoustic adjustment member supporting the microphone unit below the second mesh,
wherein the acoustic adjustment member is configured for partitioning a front side air chamber formed on a side of a front surface of the microphone unit and a rear side air chamber formed on a side of a rear surface of the microphone unit, wherein the acoustic adjustment member comprises a through hole which opens at least a part of the front surface to the front side air chamber, and wherein a volume of the rear side air chamber is larger than a volume of the front side air chamber.

9. The microphone according to claim 8, wherein a volume ratio of the front side air chamber and the rear side air chamber is in a ratio between 1:7 and 1:10.

10. The microphone according to claim 8, wherein the acoustic adjustment unit has a convex first curved surface and a concave second curved surface, and the front surface of the microphone unit is in contact with the second curved surface.

* * * * *